US006726577B1

(12) United States Patent
Peterson

(10) Patent No.: US 6,726,577 B1
(45) Date of Patent: Apr. 27, 2004

(54) GOLF BALL OF UNITARY MOLDED CONSTRUCTION

(75) Inventor: Robert Peterson, Santa Monica, CA (US)

(73) Assignee: Almost Golf, Inc., Santa Monica, CA (US)

( * ) Notice: Subject to any disclaimer, the term of this patent is extended or adjusted under 35 U.S.C. 154(b) by 0 days.

(21) Appl. No.: 10/347,720

(22) Filed: Jan. 21, 2003

(51) Int. Cl.[7] ..... A63B 37/00
(52) U.S. Cl. ..... 473/351
(58) Field of Search ..... 473/351–378, 473/569

(56) References Cited

U.S. PATENT DOCUMENTS

| | | | | |
|---|---|---|---|---|
| 3,238,156 A | | 3/1966 | Kohrn | 260/2.5 |
| 3,239,228 A | | 3/1966 | Crompton, III | |
| 3,241,834 A | | 3/1966 | Stingley | |
| 3,313,545 A | | 4/1967 | Bartsch | |
| 3,373,123 A | | 3/1968 | Brice | 260/2.5 |
| 3,384,612 A | | 5/1968 | Brandt | 260/41 |
| 3,421,766 A | | 1/1969 | Chmiel | |
| 3,438,933 A | | 4/1969 | Bartsch | 260/41.5 |
| 3,452,986 A | | 7/1969 | Behrendsen | |
| 3,992,014 A | | 11/1976 | Retford | |
| 4,165,877 A | | 8/1979 | Miller et al. | |
| 4,266,772 A | | 5/1981 | Martin et al. | |
| 4,350,795 A | * | 9/1982 | Bohm et al. | 525/194 |
| 5,082,285 A | | 1/1992 | Hamada et al. | |
| 5,330,837 A | | 7/1994 | Sullivan | 428/407 |
| 6,277,924 B1 | | 8/2001 | Hamada et al. | 525/332.3 |
| 2001/0024980 A1 | | 9/2001 | Nesbitt et al. | 473/372 |

FOREIGN PATENT DOCUMENTS

| | | | |
|---|---|---|---|
| GB | 1508829 | * | 4/1978 |
| GB | 0154735 A2 | * | 9/1985 |
| JP | 49047446 A | * | 5/1974 |

* cited by examiner

*Primary Examiner*—Gregory Vidovich
*Assistant Examiner*—Alvin A. Hunter, Jr.
(74) *Attorney, Agent, or Firm*—Thomas E. Loop

(57) ABSTRACT

The invention herein disclosed is, in one embodiment, directed to a golf ball of unitary molded construction, wherein the golf ball is foamed from a composition that comprises an ethylene-vinyl acetate copolymer, a thermoplastic elastomer, and a blowing agent, and wherein the golf ball has (i) a diameter that ranges from about 1.6 to about 1.75 inches, (ii) a weight that ranges from about 10 to about 15 grams, and (iii) a coefficient of restitution value that ranges from about 0.33 to about 0.42. In another embodiment, the present invention is directed to a golf ball of unitary molded construction, wherein the golf ball is foamed from a composition comprising: a major amount by weight of an ethylene-vinyl acetate copolymer; a minor amount by weight of a thermoplastic elastomer material, wherein the thermoplastic elastomer material is one or more of (i) a thermoplastic elastomer based on a dynamically vulcanized elastomer-thermoplastic blend, (ii) a styrene triblock copolymer thermoplastic elastomer, and (iii) an ethylene-α-olefin copolymer thermoplastic elastomer; and a blowing agent.

20 Claims, No Drawings

GOLF BALL OF UNITARY MOLDED CONSTRUCTION

TECHNICAL FIELD

The present invention relates generally to golf balls, and more specifically, to one piece golf balls of unitary molded construction that are suitable for shorter and "off-course" playing, as well as to methods of manufacturing relating thereto.

BACKGROUND OF THE INVENTION

Golf balls have traditionally been categorized into three different groups; namely, (1) one piece golf balls of unitary molded construction, (2) multi-piece golf balls (i.e., two or more concentric pieces) of layered construction, and (3) wound golf balls (i.e., core consists of a wound elastic thread) of layered construction. The physical and structural differences among these three distinct groups of golf ball construction are very significant; as are the differences in their play characteristics.

The wound-golf ball (frequently referred to as a three piece golf ball), for example, is generally made from a vulcanized rubber thread wound under tension around a solid or semi-solid center to form a wound core. The wound core is then encased in a single or multi-layer covering of one or more tough protective materials. Similarly, the multi-piece golf ball is generally made from a solid resilient core having single or multiple cover layers thereon. In both types of layered golf ball, the materials of the inner layers tend to vary significantly, while the material of the outermost cover layer is most commonly either balata or SURLYN (E.I. duPont de Nemours and Company, United States). In this regard, it is generally believed that SURLYN provides a stronger, more durable cover, whereas balata provides a softer cover that offers a bit more spin control. Regardless of the cover layer material, golf balls of layered construction have evolved significantly over the years to achieve, among other things, better flight and distance characteristics (innovations made possible, in part, by the development of new synthetic polymers and other specialty chemicals). Indeed, searchable databases maintained by the U.S. Patent and Trademark Office reveal that several thousand U.S. patents have thus far issued on inventions relating to golf balls of layered construction.

In contradistinction, one piece golf balls of unitary molded construction are typically formed from a homogeneous mass of a moldable synthetic material. As such, golf balls of this type of construction generally possess a homogeneous composition (i.e., the composition is substantially uniform between the interior and exterior of each ball); and there is generally no separate outer protective covering. One piece golf balls of unitary molded construction are known in the art and have been described over the years in the patent literature. Exemplary in this regard are U.S. Pat. Nos. 3,238,156, 3,239,228, 3,241,834, 3,313,545; 3,373,123, 3,384,612, 3,421,766, 3,438,933, 3,452,986, 3992,014, 4,165,877, 4,266,772, 5,082,285, 5,330,837, and 6,277,924. In general unitary golf balls described in these patents are suitable only for practice, and not competitive play. More importantly, however, is that these patents reveal that relatively few technological innovations have been made over the years with respect to one piece golf balls, especially with respect to the use of newly developed synthetic polymers and other specialty chemicals.

Specifically, and although numerous attempts have been made to manufacture one piece golf balls of unitary molded construction, a one piece golf ball has not yet been developed that is both relatively lightweight and able to "pop" off a club face like that of a layered construction golf ball. In addition, there has not yet been developed a one piece golf ball that has great elasticity and bouncing characteristics and that is suitable for shorter or off-course playing. Accordingly, there is still a need in the art for novel golf balls of unitary molded construction, as well as to methods of manufacturing relating thereto. The present invention fulfills these needs and provides for further related advantages.

SUMMARY OF THE INVENTION

In brief, the present invention relates generally to golf balls, and more specifically, to one piece golf balls of unitary molded construction suitable for shorter (e.g., par 3 courses) and "off-course" playing, as well as to methods of manufacturing relating thereto. In one embodiment, the present invention is directed to a golf ball of unitary molded construction, wherein the golf ball is foamed from a composition that comprises an ethylene-vinyl acetate copolymer, a thermoplastic elastomer, and a blowing agent, and wherein the golf ball has (i) a diameter that ranges from about 1.6 to about 1.75 inches, (ii) a weight that ranges from about 10 to about 15 grams, and (iii) a coefficient of restitution value that ranges from about 0.33 to about 0.42. In another embodiment, the present invention is directed to a golf ball of unitary molded construction, wherein the golf ball is foamed from a composition comprising: a major amount by weight of an ethylene-vinyl acetate copolymer; a minor amount by weight of a thermoplastic elastomer material, wherein the thermoplastic elastomer material is one or more of (i) a thermoplastic elastomer based on a dynamically vulcanized elastomer-thermoplastic blend, (ii) a styrene tri-block copolymer thermoplastic elastomer, and (iii) an ethylene-$\alpha$-olefin copolymer thermoplastic elastomer; and a blowing agent.

DETAILED DESCRIPTION OF THE INVENTION

As noted above, the present invention relates generally to golf balls, and more specifically, to one piece golf balls of unitary molded construction suitable for shorter and "off-course" playing, as well as to methods of manufacturing relating thereto. In some embodiments, the golf balls of the present invention comprise a thermoplastic elastomer material admixed together with an ethylene-vinyl acetate copolymer. More specifically, it has been discovered that unitary golf balls made from a composition comprising (i) one or more thermoplastic elastomer materials, (ii) an ethylene-vinyl acetate copolymer, and (iii) other optional fillers and/or processing additives, have highly desirable properties and characteristics which make them highly desirable for shorter and "off-course" playing. For example, it has been surprisingly discovered that, among other things, golf balls made from such novel compositions are highly suitable for "off-course" playing because they are highly elastic (and thus have a good "spring" feel when hit off a club face), durable, and travel only about one-third to about one-half as far as a conventional golf ball of layered construction. In addition, the unitary golf balls of the present invention are, in general, relatively less expensive to produce than many other types of practice or off-course golf balls.

In some exemplary embodiments, the unitary golf balls of the present invention are made of a foamed thermoplastic elastomer/ethylene-vinyl acetate copolymer admixture that has been molded into the shape of a standard sized golf ball (i.e., golf ball having a diameter of about 1.68 inches). The thermoplastic elastomer component of such an admixture is preferably a styrene block copolymer thermoplastic elastomer, and the ethylene-vinyl acetate copolymer preferably has a vinyl acetate content ranging from about 15% to about 18%. The weight of each such exemplary golf ball generally ranges from about 10 to about 25 grams (and preferably from about 12 to about 16 grams); whereas the "coefficient of restitution" (COR) generally ranges from about 0.33 to about 0.42 (and preferably from about 0.36 to about 0.39). As is appreciated by those skilled in the art, the "coefficient of restitution" is simply a measure of the ratio of the relative velocity of an elastic sphere immediately before and after a direct impact. The "coefficient of restitution" can vary from zero to one, with one being equivalent to a completely elastic collision and zero being equivalent to a completely inelastic collision.

Because many embodiments of the present invention encompass a wide range of possible polymer compositions—particularly with respect to ingredients such as, for example, thermoplastic elastomer materials and ethylene-vinyl acetate copolymers—several subsections have been provided. The several subsections provide additional disclosure pertaining to: (1) Overview of Polymer Nomenclature and Theory (2) Suitable Thermoplastic Elastomer Materials; (3) Suitable Ethylene-Vinyl Acetate Copolymers; (4) Suitable Additives; (5) Exemplary Compounding Techniques; and (6) Exemplary Unitary Golf Ball Manufacturing Processes. The several subsections are followed by several illustrative Examples that help demonstrate some of the novel features and characteristics associated with the unitary golf balls of the present invention. Finally, and although many specific details of certain embodiments of the present invention are set forth below, it is to be understood that the present invention may have additional embodiments, and that the invention may be practiced without several of the details described herein.

For purposes of clarity, a brief review of polymer nomenclature is provided to aid in the understanding of the present invention. In general, a polymer is a macromolecule (i.e., a long chain molecular chain) synthetically derived from the polymerization of monomer units or which exists naturally as a macromolecule (but which is still derived from the polymerization of monomer units). The links of the molecular chain are the monomer units. For example, polypropylene is a polymer derived from the monomer propylene ($CH_2CHCH_3$). More specifically, polypropylene is a "homopolymer," that is, a polymer consisting of a single repeating unit, namely, the monomer propylene ($CH_2CHCH_3$).

In contrast, a "copolymer" is a polymer containing two (or more) different monomer units. A copolymer may generally be synthesized in several ways. For example, a copolymer may be prepared by the copolymerization of two (or more) different monomers. Such a process yields a copolymer where the two (or more) different monomers are randomly distributed throughout the polymer chain. These copolymers are known as "random copolymers." Alternatively, copolymers may be prepared by the covalent coupling or joining of two homopolymers. For example, the covalent coupling of one homopolymer to the terminus of a second, different homopolymer provides a "block copolymer." A block copolymer containing homopolymer A and homopolymer B may be schematically represented by the following formula: $(A)_x(B)_y$ where $(A)_x$ is a homopolymer consisting of x monomers of A, $(B)_y$ is homopolymer consisting of y monomers of B, and wherein the two homopolymers are joined by a suitable covalent bond or linking spacer group. While the above formula illustrates a block copolymer having two block components (i.e., a "di-block copolymer" ), block copolymers may also have three or more block components (e.g., a "tri-block copolymer" schematically represented by the formula $(A)_x(B)_y(A)_x$ or simply A—B—A, as well as a "multiblock copolymer" schematically represented by the formula $(—A—B)_n$).

As noted above, exemplary thermoplastic elastomer materials (i.e., TPEs) of the present invention include, but are not limited to, any one or combination of the following: thermoplastic polyurethane elastomers (i.e., TPUs), polyolefin-based thermoplastic elastomers (i.e., TPOs), thermoplastic elastomers based on dynamically vulcanized elastomer-thermoplastic blends (i.e. TPVs), thermoplastic polyether ester elastomers, thermoplastic elastomers based on halogen-containing polyolefins, thermoplastic elastomers based on polyamides, styrene based thermoplastic elastomers, and ethylene-α-olefin copolymer thermoplastic elastomers. As is appreciated by those skilled in the art, many of these materials may be characterized (unlike conventional single-phase thermoplastic materials) as having one or more copolymers that comprise a major proportion of a soft segment and a minor proportion of a hard segment so as to result in a composition having a two-phase morphology.

Without necessarily prescribing to any specific scientific theory, it is believed that many-of the thermoplastic elastomers utilized in the present invention possess unique thermal and mechanical properties because they consist of hard segments that have a high glass transition temperature ($T_g$) or melting temperature ($T_m$) alternating with soft segments that have a low $T_g$ (<<room temperature). In addition to these constraints, the hard and soft segments are generally chosen such that the free energy of mixing is positive. As such, the mutual incompatibility of the segments induces microphase separation in the solid state: the hard segments tend to aggregate to form glassy or semicrystalline hard domains interspersed in a continuous soft segment matrix (hence, a two-phase morphology). The boundaries between these two phases are not well defined because there exists some degree of forced compatibility due to the relatively short average chain lengths and molecular weight distributions (i.e., generally below 4,000 atomic mass units) associated with each of the two types of segments.

In addition to the foregoing and as further appreciated by those skilled in the art, the soft segments contribute to the flexibility and extensibility of the thermoplastic elastomer, whereas the glassy or semicrystalline domains of the hard segments serve as physical crosslinks that impedes chain slippage and viscous flow. Because the crosslinks associated with the hard segments are physical in nature (in contradistinction to the chemical bonds found in vulcanized rubber), they are thermally reversible. As such, heating above the softening or melting point of the hard segment generally causes the hard domains to disassociate and become fluid. Without the hard segment tie points, the thermoplastic elastomer is able to flow, and therefore can be melt processed in conventional thermoplastic processing equipment, such as, for example, conventional injection molding equipment.

Moreover, it is to be understood that the polymer chains associated with the soft and hard segments may be synthesized with any number of monomer units—so as to range from short to long—wherein the soft and hard segment chain lengths define, in large part, the physical properties of the thermoplastic elastomer. The lengths of the soft and hard segments notwithstanding, any of the thermoplastic elastomer materials (as well as various combinations thereof) disclosed herein may be used to produce the golf balls of the present invention. For purposes of added clarification, the several different classifications of the above-identified thermoplastic elastomer materials are more fully identified and described below.

The thermoplastic polyurethane elastomers (i.e. TPUs) of the present invention are generally made from long-chain polyols with an average molecular weight of 60 to 4,000, chain extenders with a molecular weight of 61 to 400, and polyisocynanates. Within the genus of TPUs, the soft flexible segments generally comprise either hydroxyl terminated polyesters or hydroxyl terminated polyethers, whereas the hard segments generally comprise 4,1'-diphenylmethane diisocyanate. The hard segments may, however, comprise hexamethylene diisocyanate, 4,4"-dicyclohexylmethane diisocyanate, 3,3'-dimethyl-4,4"-biphenyl diisocyanate, 1,4-benzene diisocyanate, trans-cyclohexane-1,4-diisocyanate, and 1,5-naphthalene diisocyanate. As is appreciated by those skilled in the art, the characteristics of the hard segment and to a large extent the physical properties of the TPU are generally determined by the choice of the polyisocyanate and its associated chain extender. In the context of the present invention, the most important chain extenders for the above-identified TPUs are linear diols such as, for example, ethylene glycol, 1,4-butanediol, 1,6-hexanediol, and hydroquinone bis(2-hydroxyethyl) ether. Exemplary of the commercially available TPU thermoplastic elastomers include those available from DuPont (I.E. Du Pont de Nemours and Company, United States) under the tradename HYLENE, as well as those available from Morton (Morton International Specialty Chemicals) under the tradename IROGRAN.

The polyolefin-based thermoplastic elastomers (i.e. TPOs) of the present invention generally include random block copolymers (e.g., ethylene α-olefin copolymers), block copolymers (e.g, hydrogenated butadiene-isoprene-butadiene block copolymers), stereoblock polymers (e.g., stereoblock polypropylene), graft copolymers (e.g., polyisobutylene-g-polystyrene and EPDM-g-pivalolactone), and blends (e.g. blends of ethylene-propylene random copolymer with isotactic polypropylene and dynamically vulcanized blends of EPDM with a crystalline polyolefin). As is appreciated by those skilled in the art, all of these thermoplastic elastomers generally depend on crystallization of polymer chains to produce an elastomeric structure. For example, in the TPO random block copolymers (which are structurally similar to TPU random block copolymers) ethylene sequences long enough to crystallize at use temperature act as physical crosslinks for the amorphous elastic chain segments. In the TPO stereoblock copolymers, changes, in intrachain tacicity (i.e., alternating stereoregularities) provide for the alternating crystalline and amorphous sequences. Furthermore, those skilled in the art recognize that many TPO thermoplastic elastomers embrace more than one thermoplastic elastomer classification as set forth above.

The thermoplastic elastomers based on halogen-containing polyolefins of the present invention include those thermoplastic elastomers having halogen atoms attached to the polymer backbone, as well as some blends of poly(vinyl chloride) (PVC) with crosslinked or elastomeric polymers. Exemplary in this regard is melt-processable rubber (MBR), as well as blends of PVC with acrylonitrile-butadiene elastomer (NBR), copolyester (CPO), and some thermoplastic polyurethane elastomers (TPUs).

The thermoplastic elastomers based on dynamically vulcanized elastomer-thermoplastic blends of the present invention are generally made through the relatively new processing technology referred to as "dynamic vulcanization." This proprietary processing technology has provided several novel thermoplastic elastomer materials (referred to herein as "thermoplastic vulcanizates") that have many properties as good or even, in some aspects, better than those of more traditional styrenic tri-block copolymers. Exemplary in this regard are the proprietary products prepared by the dynamic vulcanization of blends of olefin rubber with polyolefin resin such as those sold by Shell and Advanced Elastomer Systems (Shell Chemical Company, United States; Advanced Elastomer Systems, L.P., United States) under the tradename SANTOPRENE. Other thermoplastic vulcanizates, now generally referred to as TPVs, include various blends of ethylene-propylene-diene terpolymer (EPDM) elastomer with polypropylene and/or polyethylene, as well as blends of polyolefin with diene rubbers such as butyl rubber, natural rubber, acrylonitrile-butadiene copolymer (NBR), and styrene-butadiene copolymer (SBR).

The thermoplastic polyether ester elastomers of the present invention are generally multiblock copolyether esters with alternating, random-length sequences of either long-chain or short-chain oxyalkylene glycols connected by ester linkages. These materials are related structurally to the polyurethane and the polyamide thermoplastic elastomers in that they also contain repeating high-melting blocks that are capable of crystallization (hard segments) and amorphous blocks having a relatively low glass transition temperature (soft segments). Typically, the hard segments are composed of short-chain cyclic ester units such as teramethylene terephthalate, whereas the soft segments are generally derived from aliphatic polyether glycols. Exemplary of the thermoplastic polyether ester elastomers are the polyether-ester block copolymers sold by DuPont (DuPont Engineering Polymers) under the tradename HYTREL.

The thermoplastic elastomers based on polyamides of the present invention are generally characterized as having a polyamide hard segment and an aliphatic polyester, aliphatic polyether, and/or aliphatic polycarbonate soft segment. The polyamide-based thermoplastic elastomers, like the TPVs, are relative newcomers to the family of thermoplastic elastomers.

The styrenic thermoplastic elastomers of the present invention are generally characterized as polystyrene-polydiene block copolymers, where both ends of each polydiene chain are terminated by polystyrene segments. With this type of thermoplastic elastomer, the rigid polystyrene domains act as multifunctional junction points to give a crosslinked elastomer network similar in some aspects to that of conventional vulcanized rubber. The polystyrene segments may include substituted polystyrene such as, for example, poly(α-methylstyrene), copolymers of α-methylstyrene, and poly(p-teri-butyl-styrene), although these types of polystyrene segments are generally less preferred. In addition, the polydiene segments may include, for example, polyisoprene, polybutadiene, ethylene-propylene copolymers, and ethylene-butylene copolymers. Exemplary of the styrenic thermoplastic elastomers are those sold by Shell (Shell Chemical Company, United States) under the tradename KRATON. In this regard, the thermoplastic elastomer material of the present invention may comprise one or more styrenic block copolymers. Preferably, such styrenic block copolymers include one or more of a styrene-ethylene/butylene-styrene block copolymer (SEBS), a styrene-ethylene/propylene-styrene block copolymer (SEPS), a styrene-butadiene-styrene block copolymer (SBS), and a styrene-isoprene-styrene block copolymer (SIS) (e.g., KRATON thermoplastic elastomer compounds. Shell Chemical Company, United States). In one embodiment, the thermoplastic elastomer of the present invention comprises a styrene-ethylene/butylene-styrene block copolymer (e.g., Tuftec, Asahi Chemicals, Japan). As is appreciated by those skilled in the art, SBS and SIS are A—B—A type block copolymers having unsaturated elastomeric central segments, whereas SEBS and SEPS are A—B—A type block copolymers having saturated elastomeric central segments. Accordingly, and because of their structure, SBS and SIS are more sensitive to oxidation than SEBS and SEPS and are therefore less preferred.

The ethylene-α-olefin copolymers of the present invention generally comprise metallocene catalyzed ethylene-α-olefin copolymers, and more preferably, metallocene catalyzed ethylene-α-olefin copolymers selected from one or more of an ethylene-butene copolymer, an ethylene-hexane copolymer, and an ethylene-octene copolymer (any one of which may also be classified as a thermoplastic elastomer). In general, the alpha-olefin component of the ethylene-α-olefin copolymer ranges from 2% to 30% by weight of the copolymer. Moreover, the metallocene catalyzed ethylene-α-olefin copolymers have densities (gm/cc) generally ranging from 0.86 to 0.95, melt indexes (ASTM 1238) generally ranging from 0.2 to 30, and melting points (° C., by DSC) generally ranging from 50–120. In one embodiment, the metallocene catalyzed ethylene-α-olefin copolymer comprises an ethylene-octene copolymer (e.g., Engage, Dupont Dow Elastomers, United States). As is appreciated by those skilled in the art, polymers manufactured using metallocene based catalyst technology have only been commercial available since about the early 1990s. More importantly, however, is that metallocene polymerization technology now allows for the manufacturing of relatively high molecular weight copolymers of very specific tacticities (e.g., isotactic and syndiotactic polymers), as well as the polymerization of almost any monomer—beyond the traditional $C_3$ to $C_8$ olefins—in an exact manner. (Note that a metallocene, as is appreciated by those skilled in the art, is a positively charged metal ion sandwiched between two negatively charged cyclopentadienyl anions).

In addition, those skilled in the art also recognize that ethylene-α-olefin copolymers, derived from metallocene based catalyst technology, include polyolefin "plastomers" or POPs (the name given to Exxon's EXACT product line, which is manufactured with proprietary EXXPOL catalyst technology, Exxon Chemical, United States) and polyolefin "elastomers" or POEs (the name given to Dupont Dow Elastomer's ENGAGE product line, which is manufactured with its proprietary INSITE catalyst technology, Dupon Dow Elastomers LLC, United States). These new polyolefin plastomers (POPS) and elastomers (POEs) are recognized as low molecular weight, linear low density ethylene-α-olefin copolymers made possible as a result of metallocene based catalyst technology. Moreover, any one of the above-identified ethylene-α-olefin copolymers, or combinations thereof, may be used in the various compositions of the present invention.

In addition to having one or more of the foregoing thermoplastic elastomers, some of the exemplary unitary golf balls of the present invention also include an ethylene-vinyl acetate copolymer component. As is appreciated by those skilled in the art, ethylene-vinyl acetate copolymers are long chains of ethylene hydrocarbons with acetate groups randomly distributed throughout the chains. Ethylene is generally copolymerized with vinyl acetate to yield ethylene vinyl acetate copolymer. Exemplary of the commercially available ethylene-vinyl acetate copolymers include those available from DuPont (I.E. Du Pont de Nemours and Company, United States) under the tradename ELVAX.

In order to optimize processability, many of the above-described thermoplastic elastomer materials and/or ethylene-vinyl acetate copolymers may be compounded (albeit optionally) to a large extent with other polymers (e.g., polypropylene, polyethylene, etc.), and may also be compounded with various oils, plasticizers, fillers and extenders, as well as other specialty additives (collectively referred to as processing additives). Indeed, and as appreciated by those skilled in the polymer compounding art, any number of various processing additives may be added to enhance one or more physical characteristics and properties of the unitary golf balls disclosed herein. Exemplary of such processing additives are those identified in Gächter R., Müller H., *The Plastics Additives Handbook*, $4^{th}$ ed., Hanser Publishers, Munich, Germany (1996) (incorporated herein by reference in its entirety). Thus, and in some embodiments, the thermoplastic elastomer materials and/or ethylene-vinyl acetate copolymers of the present invention may optionally be compounded with an "extending oil" and/or a "filler" such as calcium carbonate. Such processing additives may improve the base composition's overall processability, and enhance certain performance characteristics of the unitary golf balls made therefrom.

As is appreciated by those skilled in the art, selected amounts of one or more of the above-identified ingredients (which are all associated with certain embodiments of the present invention) may be compounded together as in the following exemplary manner. First, desired weight percentages of a selected thermoplastic elastomer (e.g., 20–25% of a SEBS block copolymer having a Shore Hardness ranging from about 45 to 75) and an ethylene-vinyl acetate copolymer (e.g., 65–75% of an ethylene-vinyl acetate copolymer, wherein the vinyl acetate content is about 15–18%), as well as desired amounts of processing additives and other specialty chemicals (e.g., colorants and stabilizers) may be added together in an appropriately sized first mixer. This dry blend may then be mixed and allowed to reach a temperature of 80° F. prior to feeding to an appropriately sized second continuous mixer. The blades of the second continuous mixer may then be rotated (e.g., at 175 rpm) so as to cause the dry blend to flux into a homogeneous melt at an elevated temperature (e.g., 340° F.). The molten composition may then be transferred (e.g., via a transfer line jacketed with nitrogen) to a single screw palletizing extruder, extruded through the die of the extruder (e.g., a multi-hole die), cooled in a water bath, and strand cut through a cutter. The resulting pellets are then ready for manufacturing exemplary unitary golf balls of the present invention.

As is appreciated by those skilled in the art, the compounded ingredients (e.g., pellets) of the present invention may be formed into unitary golf balls by, for example, injection molding (e.g., use of a gated production mold in conjunction with a hot-runner system). In connection with an injection molding process, the feedstock ingredients are combined with a suitable blowing agent (e.g., using automatic metering and mixing devices mounted directly on an injection molding machine), heated to a suitable temperature, and injected into one or more molds. In general, the chemical blowing or foaming agents are specialty additives that evolve gas, such as $N_2$ or $CO_2$, through chemical reactions, so as to produce a foamed structure within a polymeric matrix. In some embodiments, the blowing agent is an azodicarbonamide (or modified azocarbonamide), sodium bicarbonate, or a mixture thereof (e.g., Spectratech FM1150H, Quantum Chemical Corp., United States). The blowing agent is generally temperature sensitive and comprises greater than about 1% by weight of the total feedstock, and typically comprises from about 6% to about 8% by weight of the total feedstock. In general, the feedstock ingredients and blowing agent are heated at the point of injection, in large part, due to the shear friction of rapidly passing through the small opening of the gate (thereby initiating the foaming of the blowing agent). After a time period sufficient for the overall composition to effectively harden within the mold, the mold is opened and the formed unitary golf balls are removed. In order to ensure uniformity, it is also generally desirable to cool the just removed golf balls by immersion into a cold water bath for about 5 to about 7 minutes.

For purposes of illustration and not limitation, the following examples more specifically disclose various aspects of the present invention.

EXAMPLES

In order to demonstrate some of the physical characteristics of the unitary golf balls of the present invention, several golf balls were made (having a weight distribution of about 11 grams to about 14 grams) and tested for average COR values as follows:

TABLE 1

Unitary Golf Ball Compositions and Average COR values

| BALL | BASE | TPE | FOAM | COLOR | Avg. COR |
|---|---|---|---|---|---|
| 1 | 82% Elvax 560 | 9% Santoprene 8211 | 8% | 1% color | 0.3774 |
| 2 | 82% Elvax 560 | 9% Santoprene 8211 | 8% | 1% | 0.3427 |
| 3 | 82% Elvax 560 | 9% Santoprene 8211 | 8% | 1% | 0.3893 |
| 4 | 72% Elvax 560 | 18% Dynaflex G 7736 | 8% | 2% | 0.3717 |
| 5 | 72% Elvax 560 | 18% Dynaflex G 7736 | 8% | 2% | 0.3889 |
| 6 | 72% Elvax 560 | 18% Dynaflex G 7736 | 8% | 2% | 0.3683 |
| 7 | 72% Elvax 560 | 18% Dynaflex G 7736 | 8% | 2% Purple | 0.3636 |
| 8 | 72% Elvax 560 | 18% Dynaflex G 7736 | 8% | 2% | 0.3565 |
| 9 | 72% Elvax 560 | 18% Dynaflex G 7736 | 8% | 2% | 0.383 |
| 10 | 72% Elvax 560 | 18% Dynaflex G 7736 | 8% | 2% | 0.36 |
| 11 | 72% Elvax 560 | 18% Dynaflex G 7736 | 8% | 2% | 0.3482 |
| 12 | 72% Elvax 560 | 18% Dynaflex G 7736 | 8% | 2% Blue | 0.3777 |
| 13 | 72% Elvax 560 | 18% Kraton 2104 | 8% | 2% Pink | 0.3664 |
| 14 | 72% Elvax 560 | 18% Kraton RP6653 | 8% | 2% | 0.3766 |
| 15 | %100 Elvax 560 | None | 8% | 2% Green | 0.39595 |
| 16 | 72% Elvax 560 | 18% Dynaflex 2711 | 8% | 2% | 0.3781 |
| 17 | 82% Elvax 560 | 9% Dupont Engage | 8% | 2% | 0.38905 |
| 18 | 69% EVA (59% 460, 41% 260) | 17% Kraton 2104 | 9% | 5% | 0.36995 |
| 19 | 72% Elvax 560 | 18% Santoprene | 8% | 2% Blue | N/A |
| 20 | 73% Elvax 460 | 18% Kraton 2701 | 7% | 2% | 0.33265 |
| 21 | 100% GLS 70Sur | None | 8% | 2% | 0.3604 |

While the present invention has been described in the context of the embodiments illustrated and described herein, the invention may be embodied in other specific ways or in other specific forms without departing from its spirit or essential characteristics. Therefore, the described embodiments are to be considered in all respects as illustrative and not restrictive. The scope of the invention is, therefore, indicated by the appended claims rather than by the foregoing description, and all changes that come within the meaning and range of equivalency of the claims are to be embraced within their scope.

I claim:

1. A golf ball of unitary molded construction, wherein the golf ball is foamed from a composition that comprises an ethylene-vinyl acetate copolymer, a thermoplastic elastomer, and a blowing agent, and wherein the golf ball has (i) a diameter that ranges from about 1.6 to about 1.75 inches, (ii) a weight that ranges from about 10 to about 15 grams, and (iii) a coefficient of restitution value that ranges from about 0.33 to about 0.42.

2. The golf ball of claim 1 wherein the ethylene-vinyl acetate copolymer ranges from about 60 to about 90 weight percent of the composition.

3. The golf ball of claim 1 wherein the thermoplastic elastomer ranges from about 5 to about 25 weight percent of the composition.

4. The golf ball of claim 1 wherein the blowing agent ranges from about 5 to about 10 weight percent of the composition.

5. The golf ball of claim 1 wherein the ethylene-vinyl acetate copolymer has vinyl acetate content that by weight ranges from about 15% to about 18%.

6. The golf ball of claim 1 wherein the thermoplastic elastomer has a Shore Hardness ranging from about 45 to about 70.

7. The golf ball of claim 1 wherein the thermoplastic elastomer is one or more of (i) a thermoplastic elastomer based on a dynamically vulcanized elastomer-thermoplastic blend, (ii) a styrene tri-block copolymer thermoplastic elastomer, and (iii) an ethylene-α-olefin copolymer thermoplastic elastomer.

8. The golf ball of claim 1 wherein the thermoplastic elastomer is a styrene tri-block copolymer thermoplastic elastomer.

9. The golf ball of claim 8 wherein the styrene tri-block copolymer thermoplastic elastomer is a styrene-butadiene-styrene block copolymer, a styrene-ethylene/butylene-styrene block copolymer, or a combination thereof.

10. The golf ball of claim 8 wherein the styrene tri-block copolymer thermoplastic elastomer is a styrene-ethylene/butylene-styrene block copolymer.

11. A golf ball of unitary molded construction, wherein the golf ball is foamed from a composition comprising:

a major amount by weight of an ethylene-vinyl acetate copolymer;

a minor amount by weight of a thermoplastic elastomer material, wherein the thermoplastic elastomer material is one or more of (i) a thermoplastic elastomer based on a dynamically vulcanized elastomer-thermoplastic blend, (ii) a styrene tri-block copolymer thermoplastic elastomer, and (iii) an ethylene-α-olefin copolymer thermoplastic elastomer; and a blowing agent.

12. The golf ball of claim 11 wherein the ethylene-vinyl acetate copolymer ranges from about 60 to about 90 weight percent of the composition.

13. The golf ball of claim 11 wherein the thermoplastic elastomer ranges from about 5 to about 25 weight percent of the composition.

14. The golf ball of claim 11 wherein the blowing agent ranges from about 5 to about 10 weight percent of the composition.

15. The golf ball of claim 11 wherein the ethylene-vinyl acetate copolymer has vinyl acetate content that by weight ranges from about 15% to about 18%.

16. The golf ball of claim 11 wherein the thermoplastic elastomer has a Shore Hardness ranging from about 45 to about 70.

17. The golf ball of claim 11 wherein the thermoplastic elastomer is one or more of (i) a thermoplastic elastomer based on a dynamically vulcanized elastomer-thermoplastic blend, (ii) a styrene tri-block copolymer thermoplastic elastomer, and (iii) an ethylene-α-olefin copolymer thermoplastic elastomer.

18. The golf ball of claim 11 wherein the thermoplastic elastomer is a styrene tri-block copolymer thermoplastic elastomer.

19. The golf ball of claim 18 wherein the styrene tri-block copolymer thermoplastic elastomer is a styrene-butadiene-styrene block copolymer, a styrene-ethylene/butylene-styrene block copolymer, or a combination thereof.

20. The golf ball of claim 18 wherein the styrene tri-block copolymer thermoplastic elastomer is a styrene-ethylene/butylene-styrene block copolymer.

* * * * *